US006343547B1

(12) United States Patent
Callahan et al.

(10) Patent No.: US 6,343,547 B1
(45) Date of Patent: Feb. 5, 2002

(54) CANTILEVERED CYLINDER COUNTERPOISE DEVICE AND METHOD

(75) Inventors: Martin John Callahan, Dover, NH (US); John Thomas Lorrey, Kittery Point, ME (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/440,004

(22) Filed: Nov. 12, 1999

(51) Int. Cl.[7] ..... B41F 5/00; B41F 7/02; B41F 17/00

(52) U.S. Cl. ..... 101/216; 101/217; 101/479; 101/494

(58) Field of Search ..... 101/215, 216, 101/152, 153, 375, 376, 181, 217, 494, 479; 29/33 E, 234; 294/65, 86.41; 414/601, 673, 917; 242/56 R; 226/92

(56) References Cited

U.S. PATENT DOCUMENTS

| | | | | |
|---|---|---|---|---|
| 4,480,801 A | * | 11/1984 | Stone | 242/56 R |
| 4,697,516 A | * | 10/1987 | Rombout | 101/216 |
| 4,875,936 A | | 10/1989 | Hermarch | 101/218 |
| 5,094,495 A | * | 3/1992 | Littell | 294/65 |
| 5,237,920 A | * | 8/1993 | Guaraldi | 101/216 |
| 5,429,048 A | | 7/1995 | Gaffney, et al. | 101/217 |
| 5,522,316 A | | 6/1996 | Singler | 101/479 |
| 5,524,539 A | | 6/1996 | Doebler | 101/247 |
| 5,657,524 A | * | 8/1997 | Kubala | 29/234 |
| 5,678,485 A | | 10/1997 | Guaraldi | 101/247 |
| 5,813,336 A | | 9/1998 | Guaraldi, et al. | 101/218 |
| 5,993,136 A | * | 11/1999 | Vickary | 414/543 |
| 6,050,185 A | | 4/2000 | Richards | 101/142 |

FOREIGN PATENT DOCUMENTS

| | | |
|---|---|---|
| DE | 686991 | 12/1939 |
| EP | 0485913 | 5/1992 |
| EP | 0575739 | 12/1993 |
| EP | 0678381 | 10/1995 |
| EP | 0663291 | 11/1997 |
| EP | 0878299 | 7/2001 |

OTHER PUBLICATIONS

Translation of European Search Report mailed by European Patent Office on Aug. 7, 2001 (1 page).

* cited by examiner

*Primary Examiner*—Kimberly L. Asher
(74) *Attorney, Agent, or Firm*—Davidson, Davidson & Kappel, LLC

(57) ABSTRACT

A counterpoise device having a first actuating device, a first counterpoise arm connected to the first actuating device for interacting with a cantilevered cylinder, a second actuating device, and a second counterpoise arm connected to the second actuating device for interacting with an other cantilevered cylinder. The first and the second counterpoise arms have a common pivot axis. A vertical web press with a counterpoise device is also disclosed. Moreover, a method for removing gapless print sleeves includes rotating a first counterpoise arm about an axis so as to counterpoise a first end of a first cylinder, sliding a first print sleeve off of the first cylinder, rotating a second counterpoise arm about the axis so as to counterpoise a second end of a second cylinder, and sliding a second print sleeve off the second cylinder.

10 Claims, 4 Drawing Sheets

CANTILEVERED CYLINDER COUNTERPOISE DEVICE AND METHOD

BACKGROUND OF THE INVENTION

1. Field of the Invention

The present invention relates generally to web printing presses and more particularly to a method and device for counterpoising a printing press cylinder.

2. Background Information

U.S. Pat. No. 5,429,048 to Gaffney et al. discloses an offset lithographic printing press in which a web of material to be printed passes through a series of print units. Each of the print units has an upper plate cylinder, an upper blanket cylinder, a lower blanket cylinder and a lower plate cylinder. Printing plates containing images may be fastened to the plate cylinders and gapless tubular-shaped blankets may be fastened to the blanket cylinders. During a printing operation, the web passes between the upper blanket and the lower blanket.

The tubular-shaped blanket of the printing press is attached and removed axially over the blanket cylinder. The blanket cylinder during operation is attached at both ends. However, for axial removal of the blanket, a door on the work side of the printing press is opened. As a result, the blanket cylinder is cantilevered and supported solely on the gear side of the press. To support the blanket cylinder during cantilevering, a counterpoise mechanism is located at the work side of the printing press.

U.S. Pat. No. 5,678,485 discloses a counterpoise and lift mechanism for use with a printing press having axially removable sleeves. Each cylinder to be cantilevered has a counterpoise mechanism having an actuating device, such as a pneumatic cylinder, and a counterpoise lever having an arc-shaped portion for interacting with a cylinder journal at the gear side end of the cylinder. The counterpoise mechanism moves between a disengaged position when the arc-shaped portion does not contact the cylinder journal and an engaged position when the arc shaped portion contacts the cylinder in a non-printing mode to allow for sleeve removal.

The counterpoise mechanisms of U.S. Pat. No. 5,678,485 are complicated and require large amounts of space. Adjustments may be cumbersome due to the various linkages. The mechanisms also are not well suited for a vertical web arrangement.

BRIEF SUMMARY OF THE INVENTION

An object of the present invention is to provide a simple and reliable device to counterpoise a cylinder of a printing press. Another additional or alternative object is to provide a simple and reliable method for counterpoising a cylinder to be cantilevered on a printing press.

The present invention provides a counterpoise device including a first actuating device, a first counterpoise arm connected to the first actuating device for interacting with a cantilevered cylinder, a second actuating device, and a second counterpoise arm connected to the second actuating device for interacting with an other cantilevered cylinder. The first and the second counterpoise arms have a common pivot axis.

The counterpoise device of the present invention permits a compact and reliable support for the cylinders of the printing press, and also is particularly advantageous for vertical web designs, where a web of paper is running vertically.

The counterpoise device advantageously further includes an axle which provides the common pivot axis, the first and second counterpoise arms being pivotable about the axle. The counterpoise arms may include adjustable ends, so that the interaction with the cylinders can be adjusted easily. The adjustable ends also may be cam-driven to provide horizontal adjustment of the cylinder as well. The adjustable ends may be flat, or may be arc-shaped to fit tightly with a disk-shaped end of the cylinder.

Advantageously, the counterpoise arms are located directly above the cylinders, with bottom ends of the arms interacting with the cylinders and the top part of the arms connected to the actuating devices. Moreover, the two counterpoise arms preferably have meshing side surfaces facing each other, which touch each other when both counterpoise arms are deactivated.

The present invention also provides an offset vertical web press including a first blanket cylinder having a first end and a second end, and a first blanket disposed on the first blanket cylinder and axially removable over the second end. A second blanket cylinder is located aside the first blanket cylinder and has a third end and a fourth end. A second blanket is disposed on the second blanket cylinder and axially removable over the fourth end, the second blanket forming a nip with the first blanket for receiving a vertical web. A first counterpoise arm selectively supports the first end and a second counterpoise arm is connected, for example through an axle, to the first counterpoise arm for selectively supporting the third end.

The offset vertical web press of the present invention advantageously provides a compact design with axially removable blankets on counterpoised blanket cylinders. Advantageously, the first and second counterpoise arms may have a common pivot axis, which may be an axle.

The present invention also provides a method for removing gapless printing sleeves including rotating a first counterpoise arm about an axis so as to counterpoise a first end of a first cylinder, sliding a first print sleeve off of the first cylinder, rotating a second counterpoise arm about the axis so as to counterpoise a second end of a second cylinder, and sliding a second print sleeve off the second cylinder.

The use of the common axis provides a reliable and compact method for providing counterpoising to two cylinders.

Preferably, the print sleeves are blankets of an offset printing press. These blankets may be side-by-side blankets on an offset lithographic vertical web press. However, the print sleeves also may be sleeve-shaped plate cylinders, for example.

The first counterpoise arm and the second counterpoise arms preferably are rotated in different directions to effect the counterpoising, for example, the first arm being rotated counterclockwise and the second arm clockwise.

BRIEF DESCRIPTION OF THE DRAWINGS

The present invention is described below by reference to the following drawings, in which.

DETAILED DESCRIPTION

Figure 1:
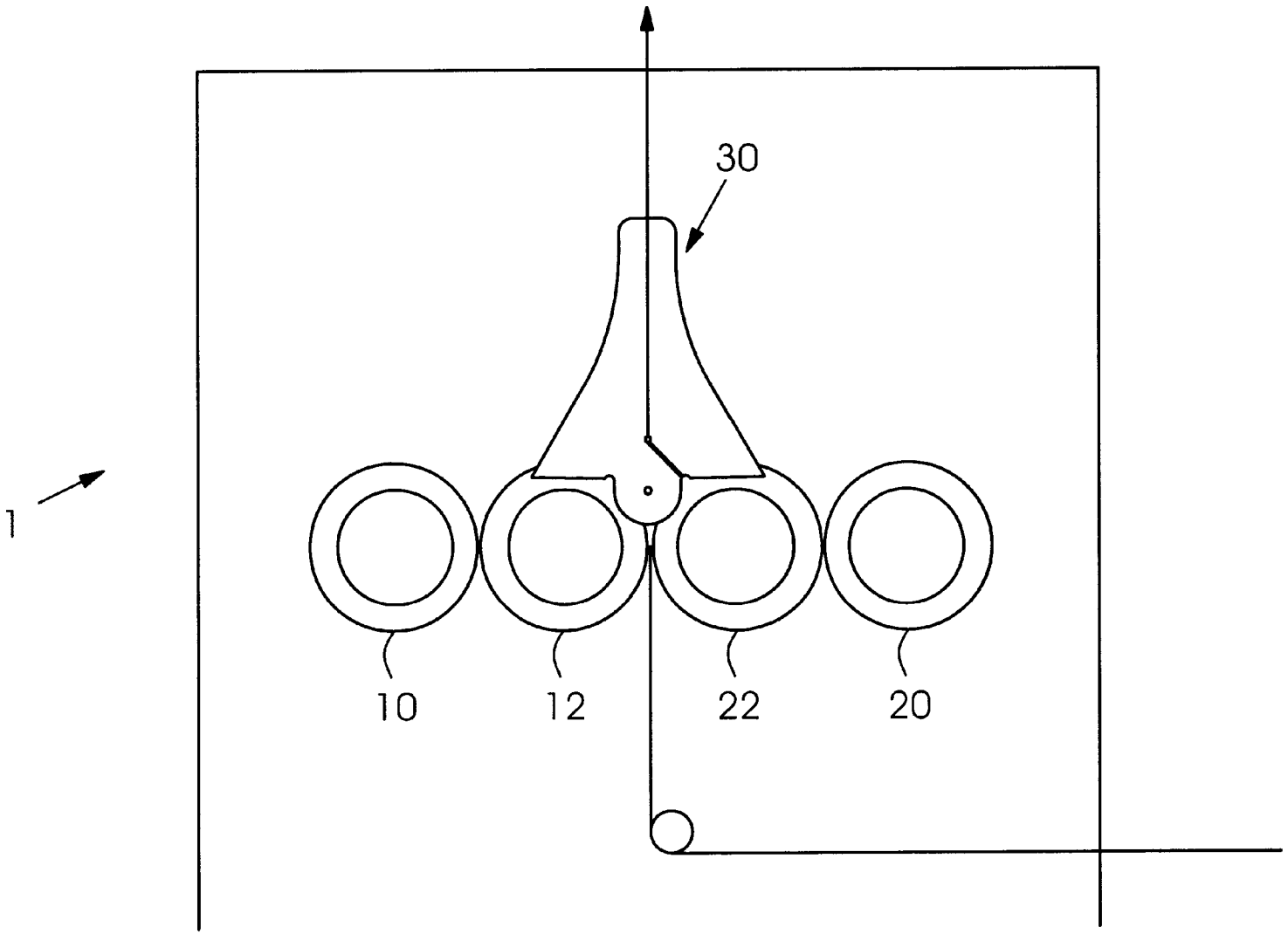
FIG. 1 shows a schematic simplified side view of a print unit of a vertical offset web printing press of one embodiment of the present invention.

FIG. 1 shows in side view a preferred embodiment of vertical web press of the present invention. Schematically depicted is an offset print unit 1 of a printing press, having a vertical web configuration. Print unit 1 includes a first plate cylinder 10, a first blanket cylinder 12, a second blanket cylinder 22 and a second plate cylinder 20. During a print operation of print unit 1, a web of material, such as paper, passes through a nip formed between blanket cylinder 12 and blanket cylinder 22.

During a print operation, ink is transferred to plate cylinders 10 and 20, which then transfer ink corresponding to images to be printed to axially removable blankets on respective blanket cylinders 12 and 22. The image is then printed onto the web as it passes through the nip.

Figure 2:
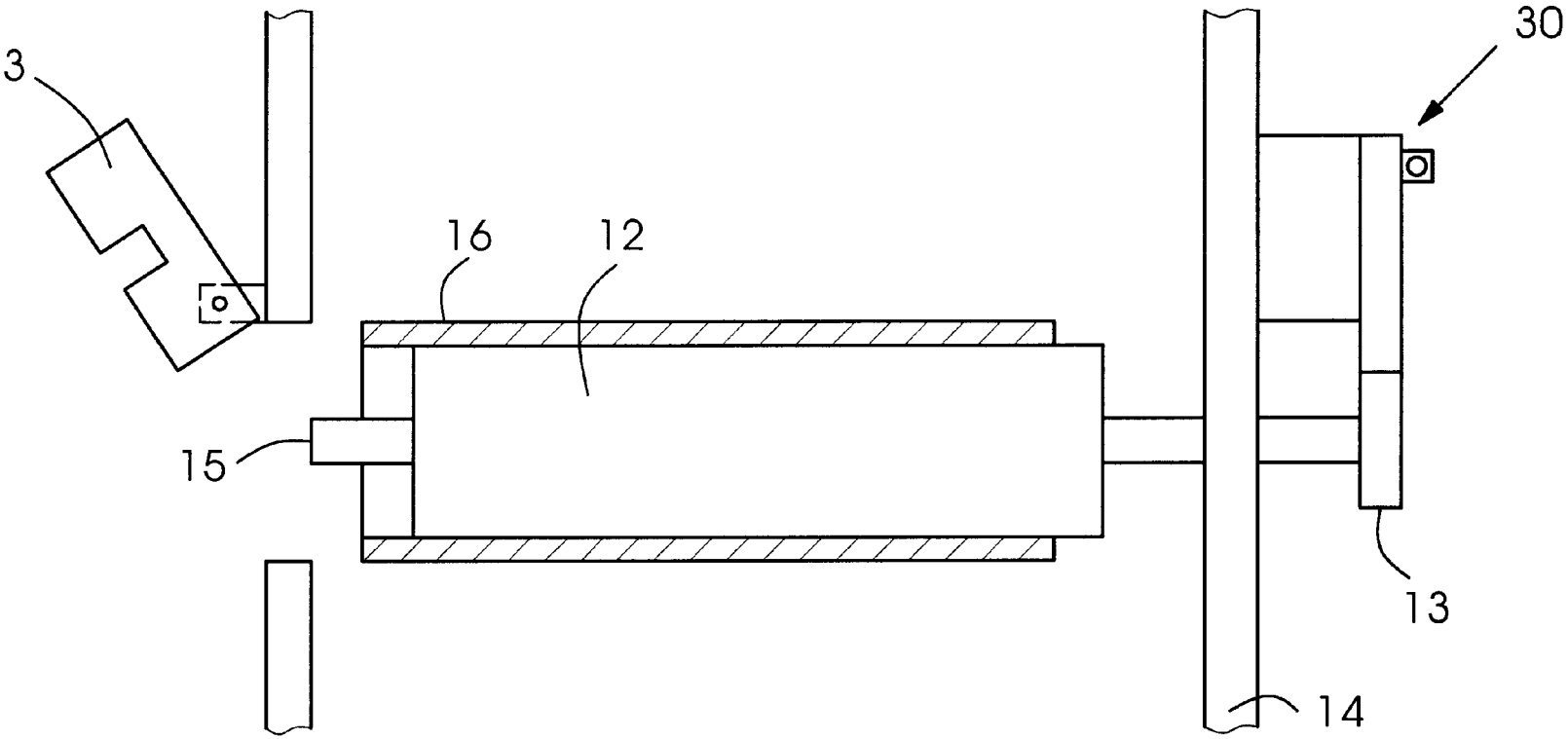
FIG. 2 shows a schematic simplified view of a cantilevered blanket cylinder of FIG. 1.

FIG. 1 shows schematically the gear side of the print unit 1. The axially removable blankets on blanker cylinders 12 and 22 are removable on the other side, i.e. the work side, of the print unit 1. As shown schematically in FIG. 2, the work side of the printing press has a movable door 3 with a clamp for the work side end 15 of blanket cylinder 12. Axially removable blanket 16 slides over the end 15, and may be similar, for example, to blankets disclosed in U.S. Pat. No. 5,429,048, which is hereby incorporated by reference herein. The movable door and clamp construction may be similar, for example, to that disclosed in U.S. Pat. No. 5,678,485, which also is hereby incorporated by reference herein.

On the gear side of the print unit as shown schematically in FIG. 1 is the counterpoise device 30 of the present invention. Counterpoise device 30 is activated when the blankets are to be removed from blanket cylinders 12 and 22, and interacts with blanket cylinder 12 through a contact adaptor 13 on the gear side end of blanket cylinder 12. The gear side end is supported in gear side frame 14 of the print unit.

Figure 3:
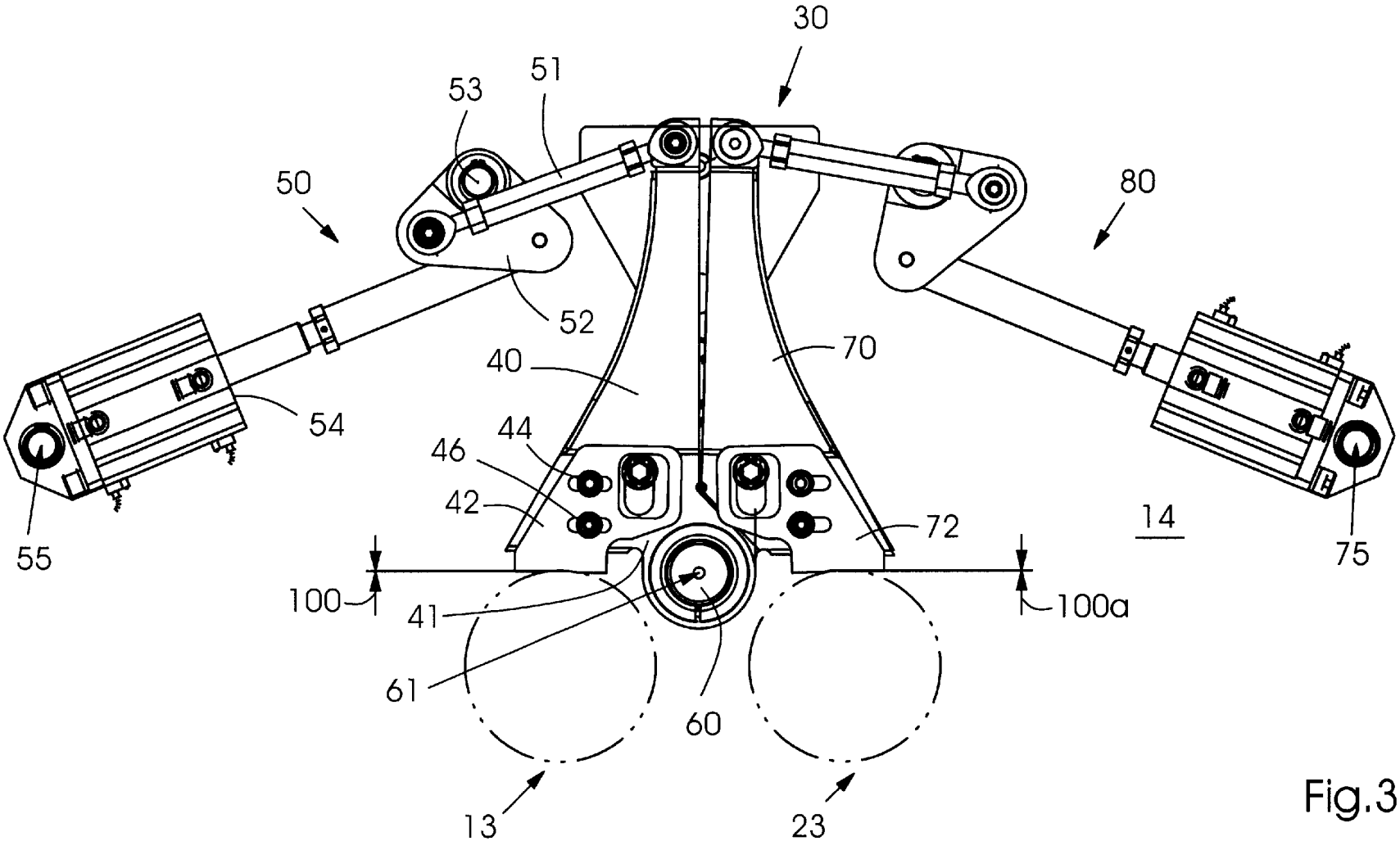
FIG. 3 shows a side view of the counterpoise device of the present invention.

FIG. 3 shows a side view of counterpoise device 30 in detail. The gear side end of blanket cylinders 12 and 22 have contact adaptors 13 and 23, respectively. Selectively acting on contact adaptor 13 is a first counterpoise arm 40, which is rotatable about an axle 60 having an axis 61. Arm 40 has a ring extension 41 fitting about the axle. Axle 60 is fixed to gear side frame 14. First arm 40 includes an adjustable end 42, which may be adjusted by bolts 44 and 46, or may be driven by a cam for horizontal movement. Although shown having a flat bottom surface, adjustable end 42 also may be arc-shaped at the bottom to form fit adaptor 13. Opposite the adjustable end 42 is a connection to a first actuating device 50 which includes a link 51, a rotatable plate 52 rotatable about a bolt 53 attached to frame 14, and a pneumatic device 54, which is attached rotatably at one end to the frame by a bolt 55. Pneumatic device 54 can rotate plate 52 to rotate arm 40 about axis 61.

For the second blanket cylinder 22, counterpoise device 30 has a second counterpoise arm 70 with a second adjustable end 72 to act on contact adaptor 23. Second arm 70 has a ring extension about the axle 60 which is located behind ring extension 41. A second actuating device 80 similar to actuating device 50 is attached between the second counterpoise arm 70 and a bolt 75.

Figure 4:
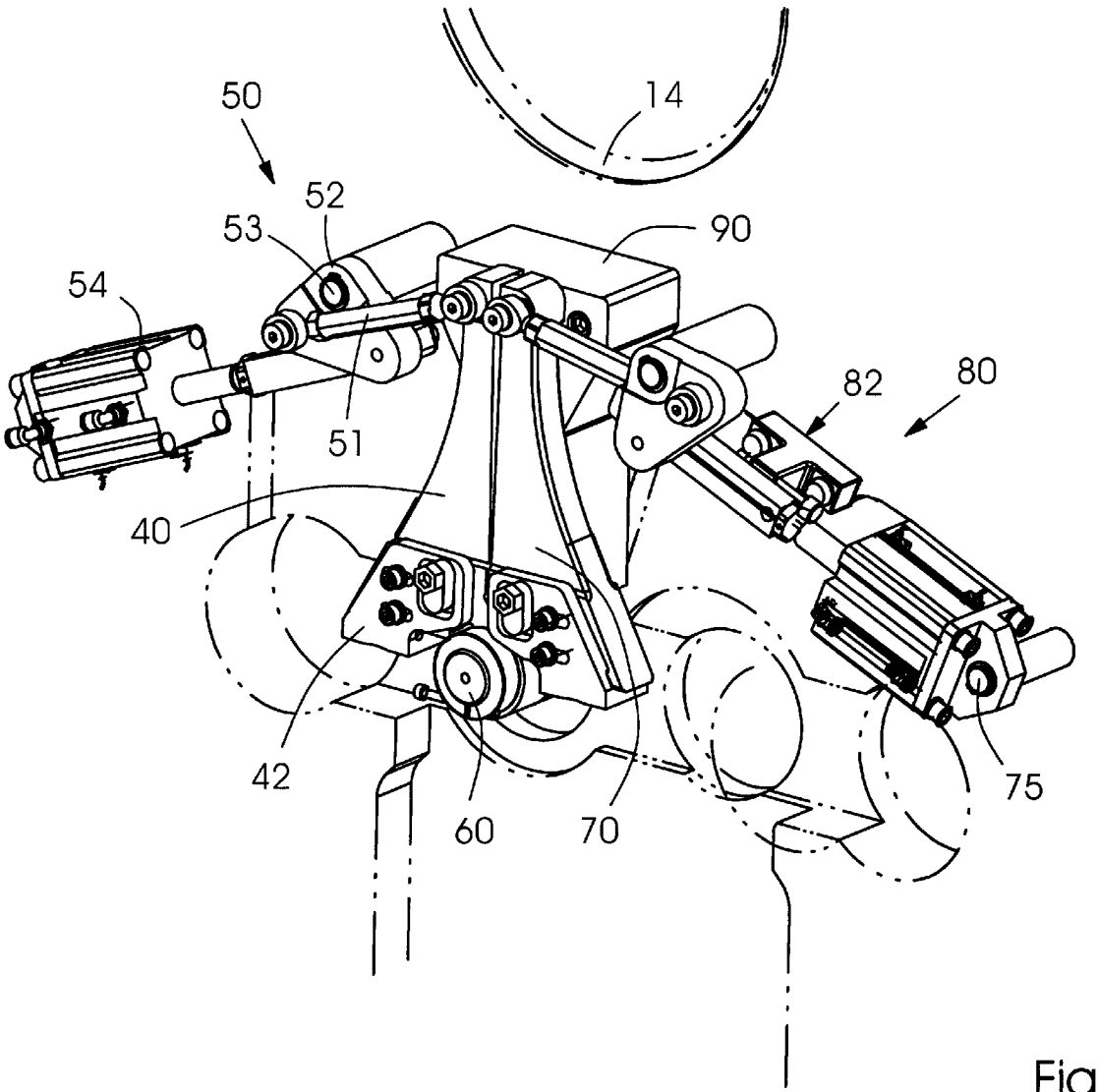
FIG. 4 shows a perspective view of the counterpoise device of FIG. 3.

As shown in FIG. 4, actuating device 80 has a stop 82 attached to frame 14 for limiting movement when the actuating device is not actuated. Actuating device 50 may have a similar stop. A support 90 may also support the arms 40, 50, while still permitting rotational movement of the arms about axle 60.

During a print operation, clearances 100,100*a* as shown in FIG. 3 exists between counterpoise arms 40, 70, respectively, and their respective contact adaptors 13 and 23. To make a blanket change on the printing press shown in FIGS. 1 and 2, the actuating device 50 is actuated. This actuation pulls the top end of arm 40 toward bolt 55, which rotates the counterpoise arm 40 counterclockwise about axis 61. End 42 thus contacts and applies pressure to contact adaptor 13. Door 3 may then be opened and the blanket 16 slid off blanket cylinder 12. A new blanket may then be inserted, the door closed and actuating device 50 deactivated. Clearance 100 thus results. To change a blanket on blanket cylinder 22 a similar process is used with actuating device 80 being actuated and arm 70 being rotated clockwise about axis 61.

The term "arm" as used herein is generic and can mean any rotatable structure, including the triangular-shaped arm of FIG. 3. The term "printing press" can include any type of printing machine, such as an offset printing press or a copier. The term "printing sleeve" or "print sleeve" may include, for example, a sleeve-shaped blanket or image-carrying plate. The counterpoise device of the present invention, although described above for use with two blanket cylinders, also may be used to counterpoise a blanket cylinder and a plate cylinder or any other combination of print cylinders. Although not preferable, the counterpoise device may also be usable with a horizontal web configuration. The pneumatic devices for the actuating devices used may be BIMBA air cylinders with a 50 mm bore diameter. However, other types of actuating devices, such as hydraulically or magnetically operated devices are also possible.

What is claimed is:

1. In combination a printing press and a counterpoise device, the counterpoise device comprising:

a first actuating device;

a first counterpoise arm connected to the first actuating device for interacting with a first cantilevered cylinder of the printing press;

a second actuating device; and a second counterpoise arm connected to the second actuating device for interacting with a second cantilevered cylinder of the printing press, the first and the second counterpoise arms having a common pivot axis.

2. The counterpoise device as recited in claim 1 further comprising an axle, the first and second counterpoise arms being pivotable about the axle.

3. The counterpoise device as recited in claim 1 wherein the first counterpoise arm includes an adjustable end for contact with the first cantilevered cylinder.

4. The counterpoise device as recited in claim 1 wherein the first counterpoise arm is located above a gear side end of the first cantilevered cylinder.

5. The counterpoise device as recited in claim 1 wherein the first counterpoise arm has a flat side surface facing another flat side surface of the second counterpoise arm.

6. An offset vertical web press comprising:

a first blanket cylinder having a first end and a second end;

a first blanket disposed on the first blanket cylinder and axially removable over the second end;

a second blanket cylinder located adjacent to the first blanket cylinder and having a third end and a fourth end;

a second blanket disposed on the second blanket cylinder and axially removable over the fourth end, the second blanket forming a nip with the first blanket for receiving a vertical web;

a first counterpoise arm for selectively supporting the first end of said first blanket cylinder; and a second counterpoise arm connected to the first counterpoise arm for selectively supporting the third end of said second blanket cylinder.

7. The offset vertical web press as recited in claim 6 wherein the first and second counterpoise arms have a common pivot axis.

8. The offset vertical web press as recited in claim 7 further comprising an axle, the first and second counterpoise arms being connected by and pivotable about the axle.

9. The offset vertical web press as recited in claim 6 wherein the first counterpoise arm includes an adjustable end for contact with the first blanket cylinder.

10. The offset vertical web press as recited in claim 6 wherein the first counterpoise arm is located above a gear side end of the first blanket cylinder.

* * * * *